US010472132B2

(12) United States Patent
Mutterle

(10) Patent No.: US 10,472,132 B2
(45) Date of Patent: Nov. 12, 2019

(54) CLOSING ASSEMBLY FOR A BOTTLE, ASSOCIATED BOTTLE AND ASSEMBLY METHOD

(71) Applicant: Antonio Mutterle, Breganzona (IT)

(72) Inventor: Antonio Mutterle, Breganzona (IT)

( * ) Notice: Subject to any disclaimer, the term of this patent is extended or adjusted under 35 U.S.C. 154(b) by 188 days.

(21) Appl. No.: 15/573,347

(22) PCT Filed: Jun. 29, 2016

(86) PCT No.: PCT/EP2016/065111

§ 371 (c)(1),
(2) Date: Nov. 10, 2017

(87) PCT Pub. No.: WO2017/001459

PCT Pub. Date: Jan. 5, 2017

(65) Prior Publication Data

US 2018/0134457 A1 May 17, 2018

(30) Foreign Application Priority Data

Jun. 29, 2015 (IT) ..... UB2015A1758

(51) Int. Cl.

| | |
|---|---|
| ***B65D 39/00*** | (2006.01) |
| ***A61J 1/14*** | (2006.01) |
| ***B65D 41/62*** | (2006.01) |
| ***B65D 51/00*** | (2006.01) |

(52) U.S. Cl.

CPC ..... *B65D 39/0017* (2013.01); *A61J 1/1412* (2013.01); *B65D 41/62* (2013.01); *B65D 51/002* (2013.01)

(58) Field of Classification Search

CPC ..... B65D 51/002; B65D 51/2807; B65D 2101/0023; B65D 39/0017; B65D 41/62; A61J 1/1412

USPC ..... 215/341, 249, 264

See application file for complete search history.

(56) References Cited

U.S. PATENT DOCUMENTS

| | | | |
|---|---|---|---|
| 5,819,964 | A | 10/1998 | Grimard |
| 2012/0160850 | A1 | 6/2012 | Gelibert et al. |

FOREIGN PATENT DOCUMENTS

| | | | |
|---|---|---|---|
| FR | 2927316 | A1 | 8/2009 |
| FR | 2950035 | A1 | 3/2011 |
| JP | 2011-230839 | A | 11/2011 |
| WO | 2005/000703 | A2 | 1/2005 |

(Continued)

OTHER PUBLICATIONS

International Search Report dated Sep. 26, 2016 in PCT/EP2016/065111 filed Jun. 29, 2016.

*Primary Examiner* — Andrew D Perreault

(74) *Attorney, Agent, or Firm* — Oblon, McClelland, Maier & Neustadt, L.L.P.

(57) ABSTRACT

A closing assembly for a bottle, the assembly including a cage, a closing stopper, and a ring nut. The cage includes a side wall with an inner surface including a bead and a lip spaced to form a seat for a collar of the bottle. Retaining teeth are provided for keeping a head of the closing stopper in position. An outer surface of the side wall of the cage includes an annular cavity and a side wall of the ring nut includes an inner lower projection configured to engage the annular cavity in a preassembly configuration. The cage further includes a plurality of windows. Each window includes a tongue connected to a lower edge of the window along a hinge line. The lip is formed at an upper end of each tongue and each tongue is rotatable elastically about the hinge line.

12 Claims, 16 Drawing Sheets

(56) References Cited

FOREIGN PATENT DOCUMENTS

| | | | |
|---|---|---|---|
| WO | 2012/152796 | A1 | 11/2012 |
| WO | 2015/082354 | A1 | 6/2015 |

CLOSING ASSEMBLY FOR A BOTTLE, ASSOCIATED BOTTLE AND ASSEMBLY METHOD

The present invention relates to the sector of systems for sealingly closing a container, for example a bottle. In particular, the invention relates to a closing assembly for a bottle or a similar container. The present invention also relates to a container, in particular, but not exclusively, a bottle provided with a closing assembly. The invention also relates to an associated assembly method. The invention is applicable to bottles containing lyophilized products, for example lyophilized medicines, or powders, liquids or the like.

BACKGROUND ART

For the sake of simplicity, the present invention will be described substantially only with reference to a particular type of container, a bottle. However, the present invention is not limited only to these containers and the choice of referring only to bottles is not to be understood in any way as limiting the scope of protection of the invention.

Moreover, although a possible field of application is the pharmaceutical field, the present invention is also applicable to other (related or different) fields, for example the cosmetics sector, the food sector, the sector of food supplements or to any other sector where it is required to store a substance (in any state, for example a solid, liquid, lyophilized, gel, or other state) in a safe and sealed manner inside a container.

WO 2012/152796 A1 and FR 2 927 316 describe a closing assembly for a bottle. In both solutions, the assembled closing assembly is associated with the bottle by inserting the closing stopper inside the mouth of the bottle.

WO 2005/000703 A2 describes a closing assembly for a lyophilizer.

WO 2015/082354 A1 discloses a closure assembly for a bottle and an assembly method.

U.S. Pat. No. 5,819,964 A discloses a lyophilization closure assembly for a medicament container for use during a lyophilization process.

BRIEF SUMMARY OF THE INVENTION

The inventor has noted in tests that, during the operations which precede the sealing of the bottle according to the solutions described in WO 2012/152796 A1 and FR 2 927 316, the closing assembly inserted in the mouth of the bottle is not stable and is not straight. Therefore, the Applicant has established that, on various occasions, the closing assembly comes out of the mouth of the bottle and falls. In fact, during transportation from the filling line to the lyophilizer, for example, both by means of an automatic conveyor belt and by means of manually inserted trays, vibrations are generated and these may easily cause the closing assembly to fall. This means that that particular bottle can no longer be used. In particular, the fact that a closing assembly becomes detached from the bottle and falls to the ground means that the substance introduced inside the bottle cannot be used and must be thrown away with a consequent economic loss. Incorrect positioning of the assembly, moreover, could even result in breakage of said bottle with consequent contamination of the other bottles present which would have to be washed in order to safeguard the health of the persons who must work, on occasions, also with highly active substances. All this requires extraordinary intervention along the production line, with a consequent interruption in the bottle closing process, with reduced productivity and consequent economic loss.

The main disadvantage instead of the solution described in WO 2005/000703 A2 is that the sealing stopper is not properly retained in position by the cage, but may fall to the ground during movement thereof, with all the drawbacks mentioned above in connection with WO 2012/152796 A1 and FR 2 927 316. Moreover, the diameter of the closing assembly according to WO 2005/000703 A2 is greater than the diameter of the bottle and this creates major problems during assembly, during the lyophilization steps, labelling, storage and transportation of the bottles, such that use thereof during production, in particular when the bottles are arranged next to each other, is not possible.

The aim of the inventor is to provide a simple, effective and reliable closing assembly which is stable when associated with the mouth of a bottle so that the risk that it (or only one of its components) may fall to the ground is reduced to a minimum or practically eliminated.

Moreover, the inventor has realized that the closing step requires a considerable pressing force at least due to the fact that the cage, with its inwardly projecting mouldings (and therefore smaller diameter), must be pushed with force downwards. If the thickness of the side wall of the cage is small, it may be pushed with less difficulty, but at the same time the cage is weak. If the thickness of the side wall of the cage is greater, completing closure of the bottle involves a pressure which is too high, in particular when one considers that usually several tens of bottles are closed at the same time.

One object of the present invention is therefore to provide a closing assembly in which the cage is strong and, at the same time, the force required to press the closing assembly towards the bottle is less than the force normally used in closing assemblies of the known type.

According to one aspect, the present invention provides a closing assembly with a cage configured to have a seat for stable engagement with the collar of a bottle and a device for retaining a sealing stopper and preventing it from being separated from the cage. The seat is formed by a lower bead and by a lip situated at the end of tongues rotatable about a hinge line.

According to a first aspect, the present invention provides an assembly for closing a bottle or the like comprising a cage, a closing stopper and a ring nut with a protective sealing cap, wherein:

- the cage is substantially cup-shaped and comprises a side wall with an inner surface comprising a bead and a lip spaced in such a way as to form a seat for a collar of the bottle;
- the closing stopper comprises a head, wherein the head comprises an upper surface and a lower surface;
- the ring nut is cup-shaped and comprises a side wall;
- the inner surface of the side wall of the cage comprises a retaining tooth for retaining in position the head of the closing stopper at the lower surface;
- the retaining tooth projects cantilevered from the inner surface of the side wall of the cage;
- the outer surface of the side wall of the cage comprises an annular cavity;
- the side wall of the ring nut comprises an inner lower projection configured so as to engage the annular cavity in a preassembly configuration;

the side wall of the cage comprises a plurality of windows and each of said windows comprises a tongue connected to a portion of the lower edge of the window along a hinge line;

the lip is formed at the free end of each tongue; and each tongue is elastically rotatable about the hinge line.

Preferably, each tongue has a rounded head. Thanks to the rounded head, during the assembly, the engaging tongues can rotate about the hinge line without the outer diameter of the sealing assembly exceeds the maximum diameter of the bottle. This is extremely advantageous in that a number of bottles arranged adjacent to each other (side by side) can be managed and closed at a same time. This saves space and results in a stable configuration.

Preferably each tongue has a step configured for acting as a stop for a knee of the ring nut. In embodiments, each tongue has an inclined surface as far as the hinge line. In this manner, the hinge line is created where the thickness is lower.

Preferably the side wall of the cage comprises a rim which extends circumferentially between a lower free edge of the cage and the lower edge of the windows.

In embodiments, the rim comprises a surface inclined outwards from said hinge line.

In embodiments, the rim comprises a plurality of slits. The slits are preferably open at the free edge of the cage and extend beyond the hinge line.

Preferably the slits extend over a length which is less than the height of the tongues so as to ensure a greater fastening elasticity depending on the tolerance of the bottle.

According to another aspect, the present invention provides a bottle comprising a closing assembly of the aforementioned type.

Conveniently the bottle is of the standard type, without blowback, for example 2R type.

According to yet another aspect, the present invention relates to a method for assembling a closing assembly of a bottle or the like to be assembled on the mouth of said bottle. The method comprises:

providing a cage, a closing stopper and a ring nut, wherein:

the cage is substantially cup-shaped and comprises a side wall with an inner surface comprising a bead and a lip spaced in such a way as to form a seat for a collar of the bottle;

the closing stopper comprises a head, wherein the head comprises an upper surface and a lower surface;

the ring nut is cup-shaped and comprises a side wall;

the inner surface of the side wall of the cage comprises a retaining tooth for retaining in position the head of the closing stopper at said lower surface;

the retaining tooth projects cantilevered from the inner surface of the side wall of the cage;

the outer surface of the side wall of the cage comprises an annular cavity;

the side wall of the ring nut comprises an inner lower projection configured so as to engage the annular cavity in a preassembly configuration;

the side wall of the cage comprises a plurality of windows and each of said windows comprises a tongue connected to a portion of the lower edge of the window along a hinge line;

the lip is formed at the free end of each tongue; and each tongue is elastically rotatable about the hinge line, pushing the head of the sealing stopper toward the base of the cage, partially fitting said ring nut on said cage so that the knee engages the annular cavity, assembling said cage on said bottle so that the collar of the bottle abuts between said spur and said lip.

Preferably, each tongue comprises a rounded head so that during assembly, the engaging tongues can rotate about the hinge line without the outer diameter of the sealing assembly exceeds the maximum diameter of the bottle.

In some embodiments, the method also comprises the step of providing a cap and engaging the cap with the ring nut.

A detailed description of the invention now follows, being provided purely by way of a non-limiting example, to be read with reference to attached sets of drawings in which.

Figure 6A:
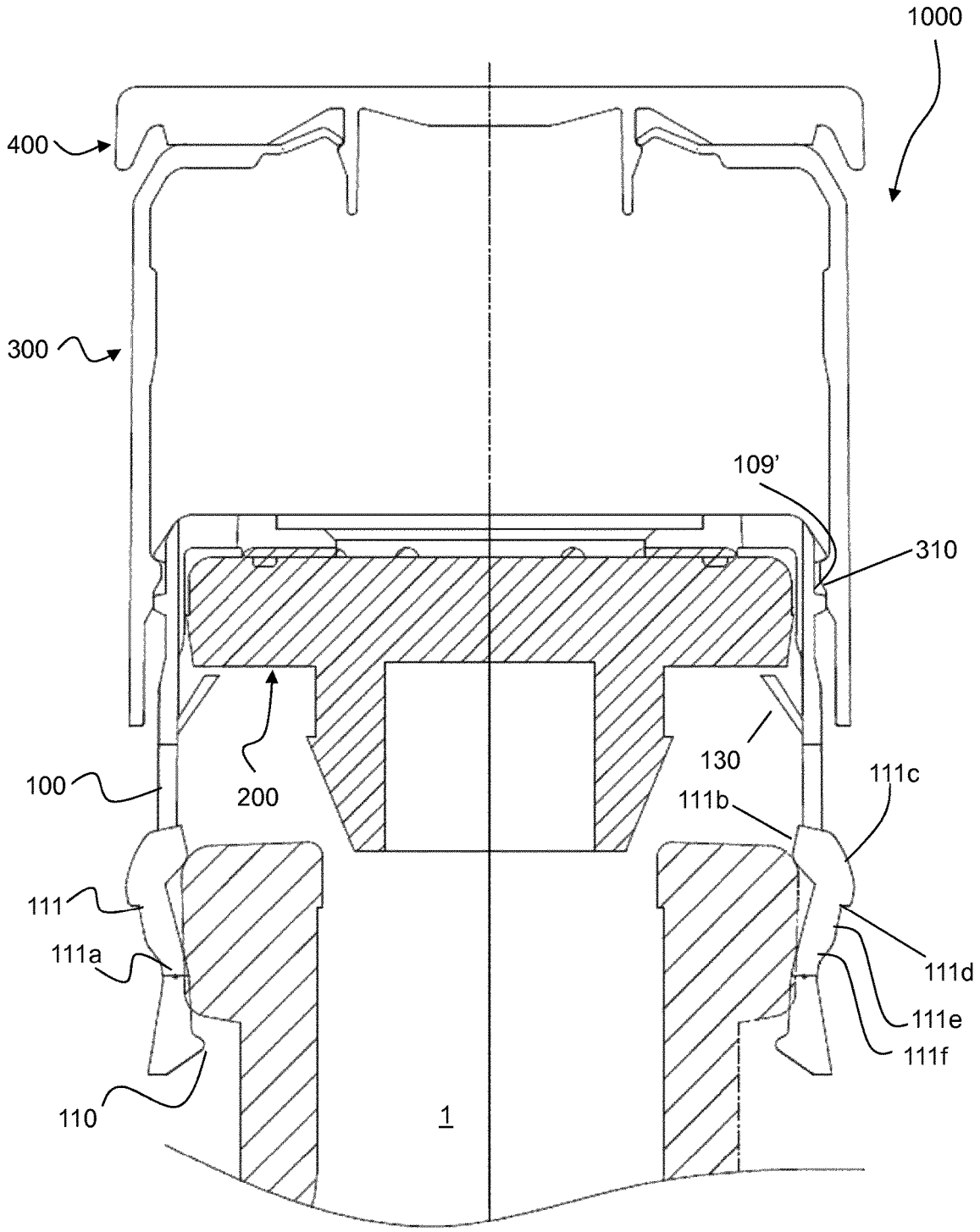
Figure 6B:
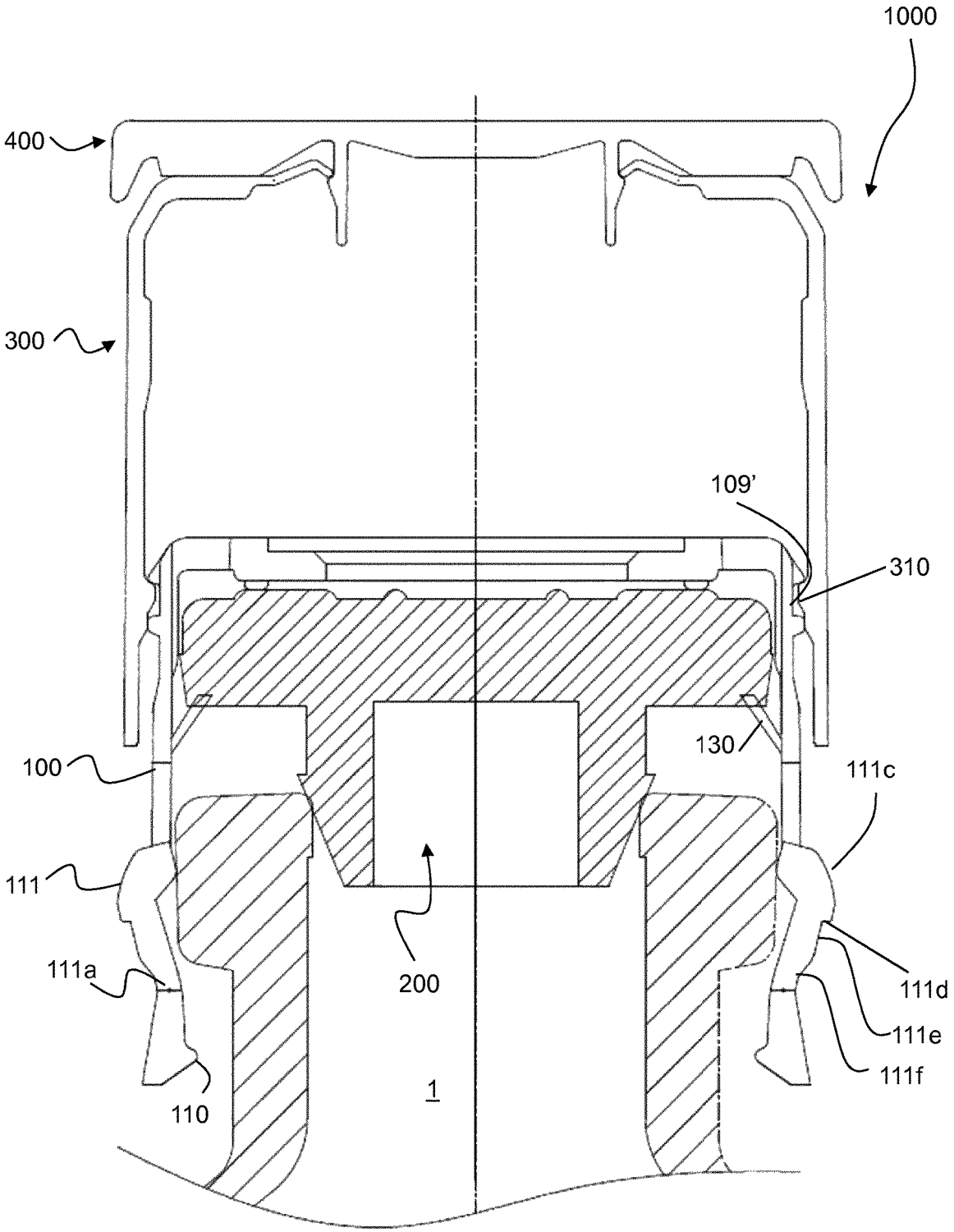
Figure 6C:
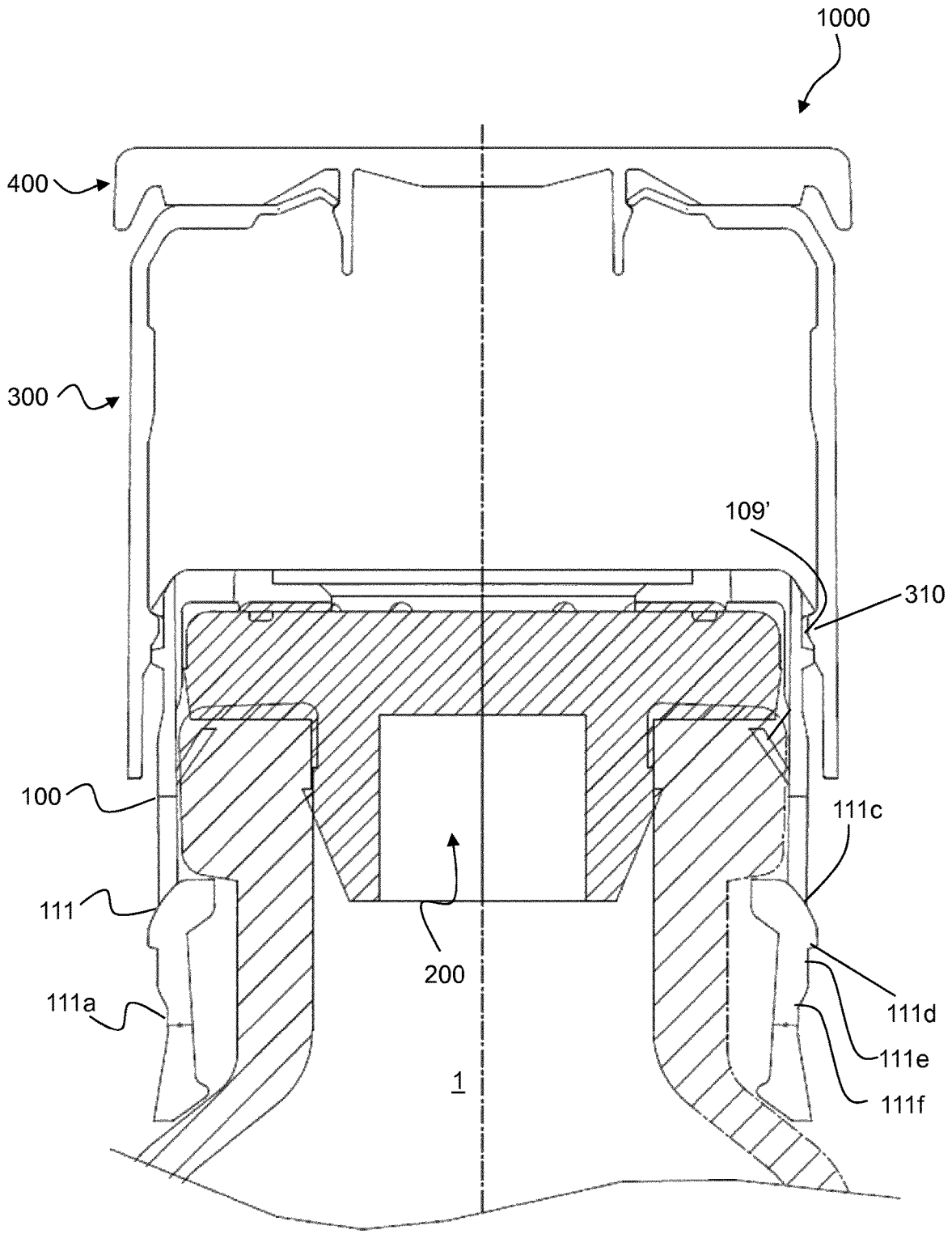
Figure 6D:
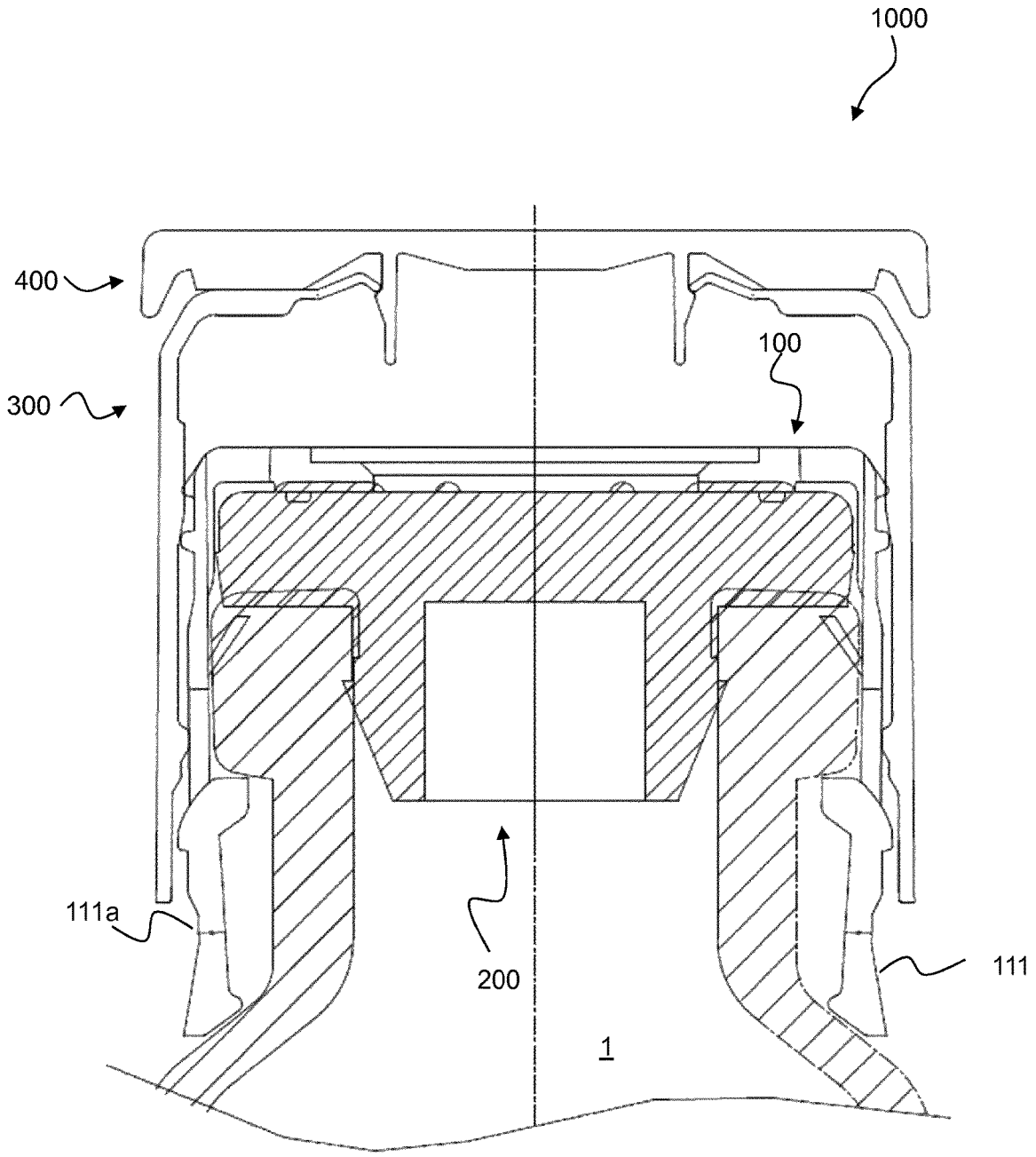
Figure 6E:
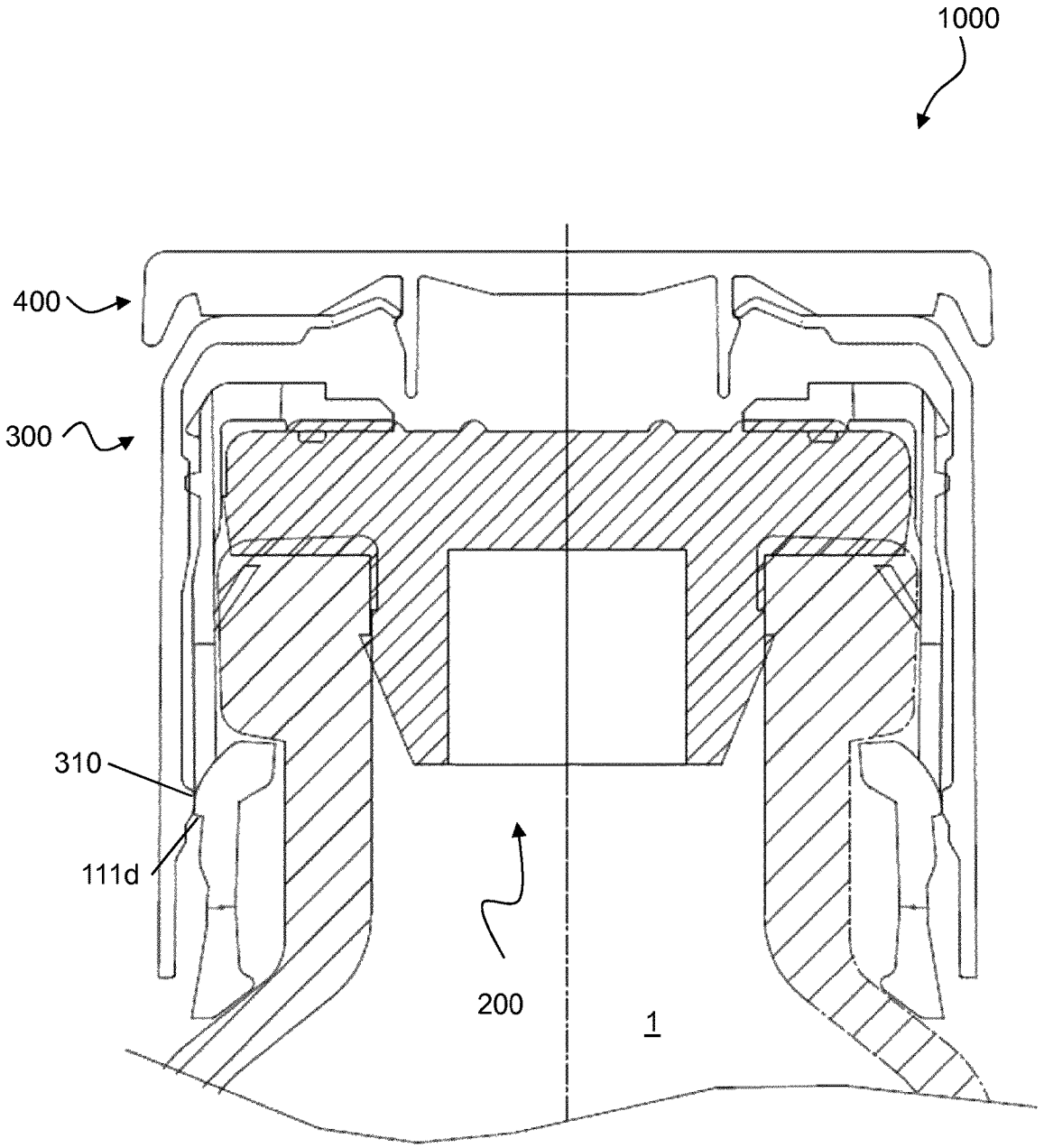
Figure 6F:
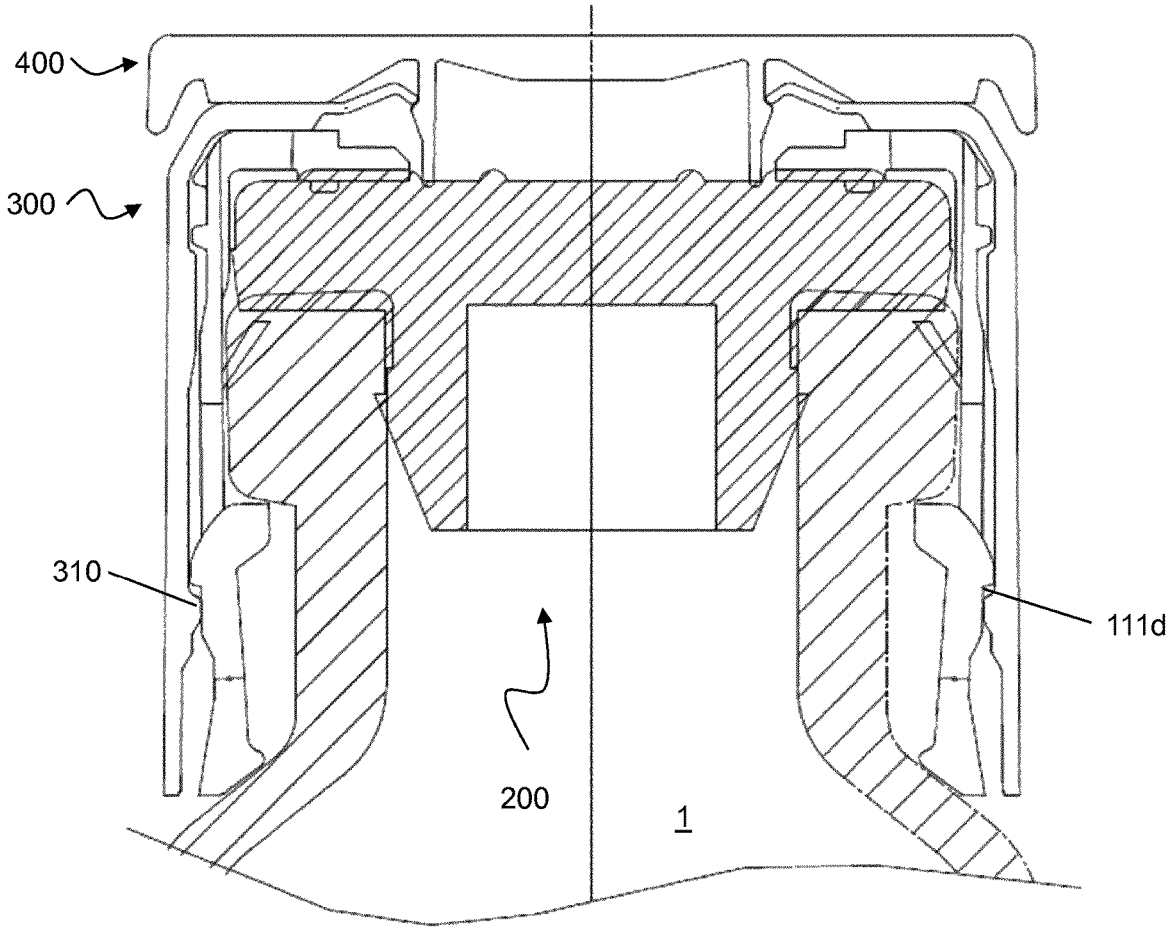
Figure 7A:
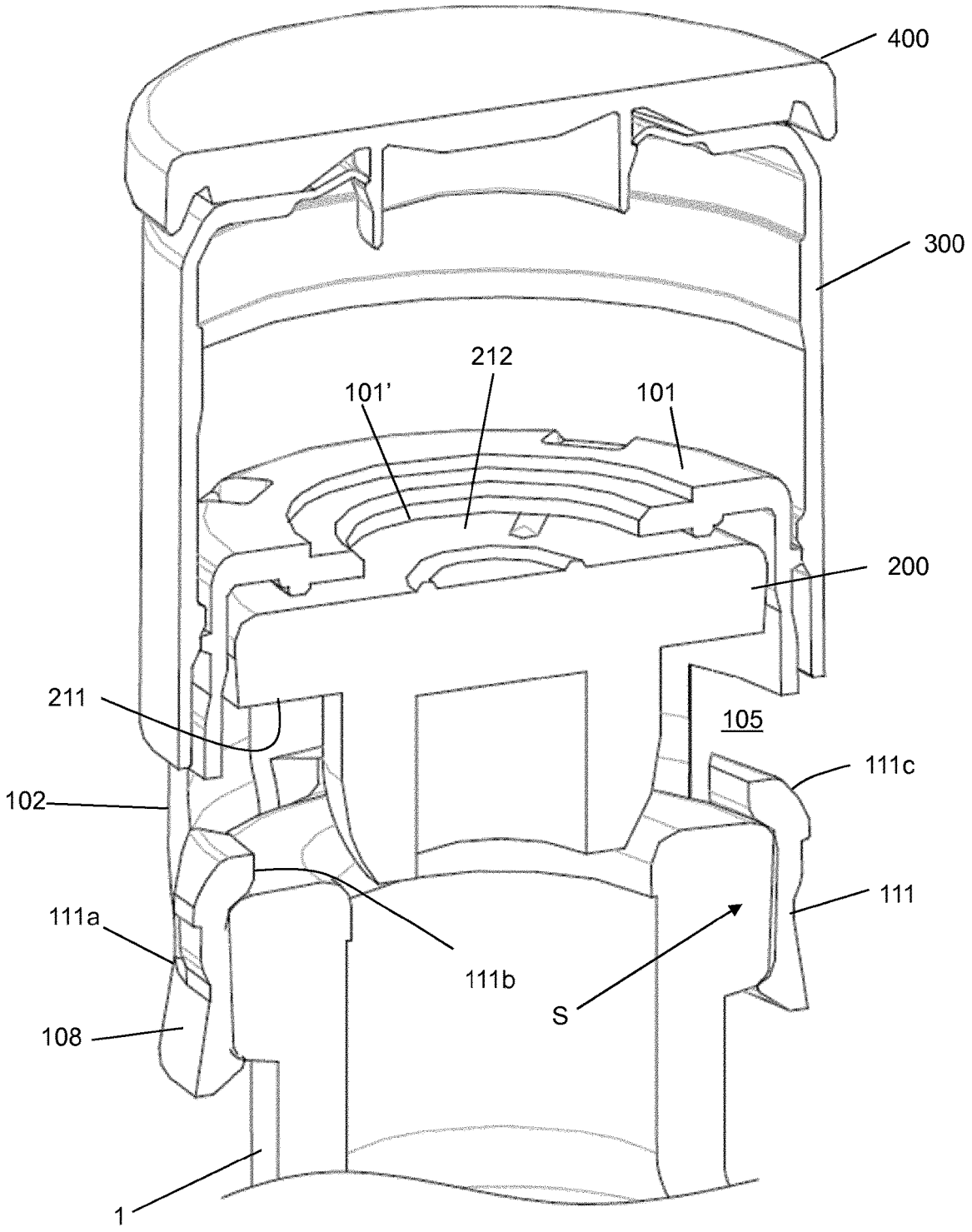
Figure 7B:
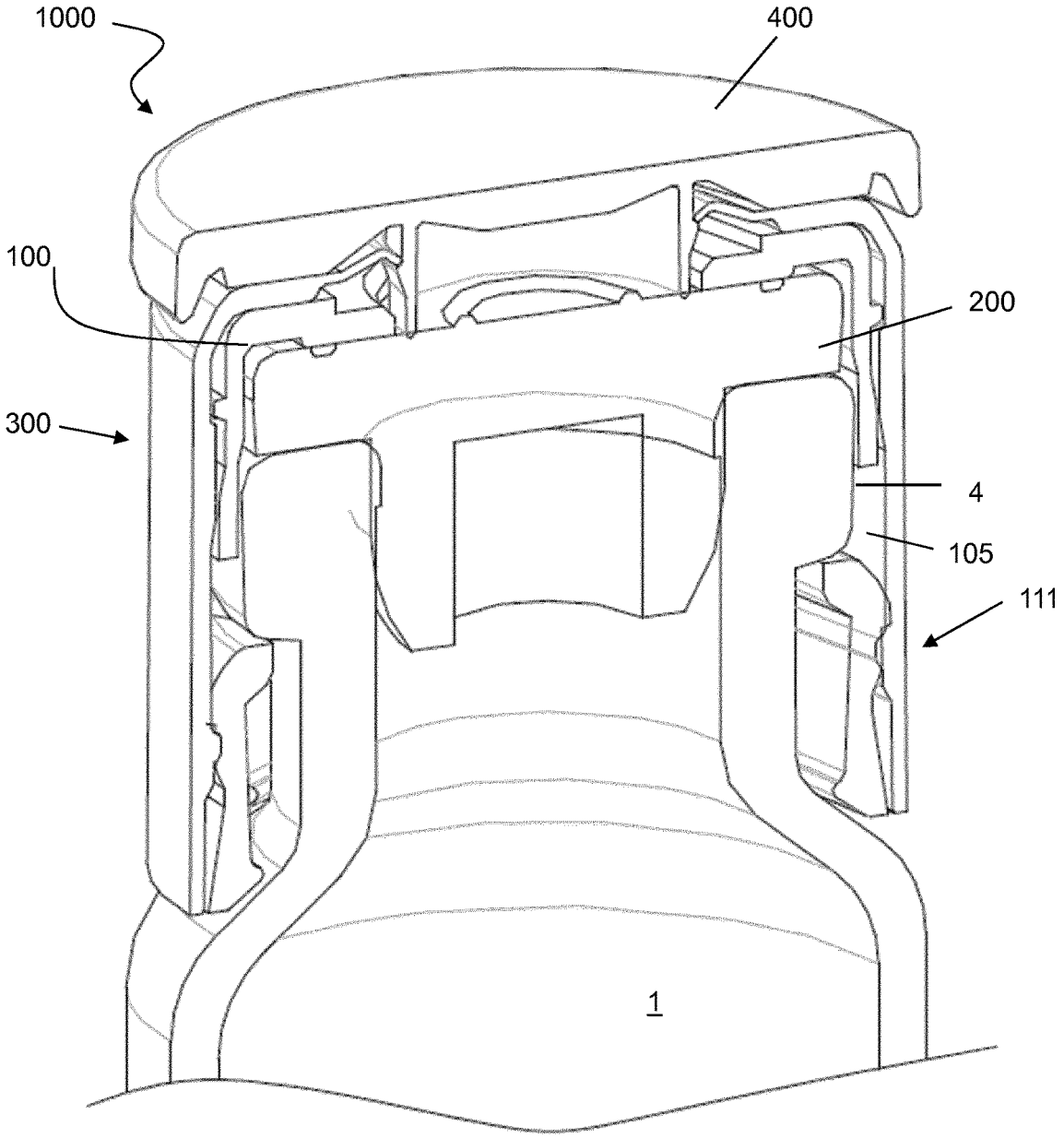

FIGS. 6*a*-6*f* show, in sequence, some of the steps for closing the bottle with the closing assembly according to the present invention;

FIGS. 7*a* and 7*b* show three-dimensional cross-sections corresponding to FIGS. 6*a* and 6*f;*

Figure 8:
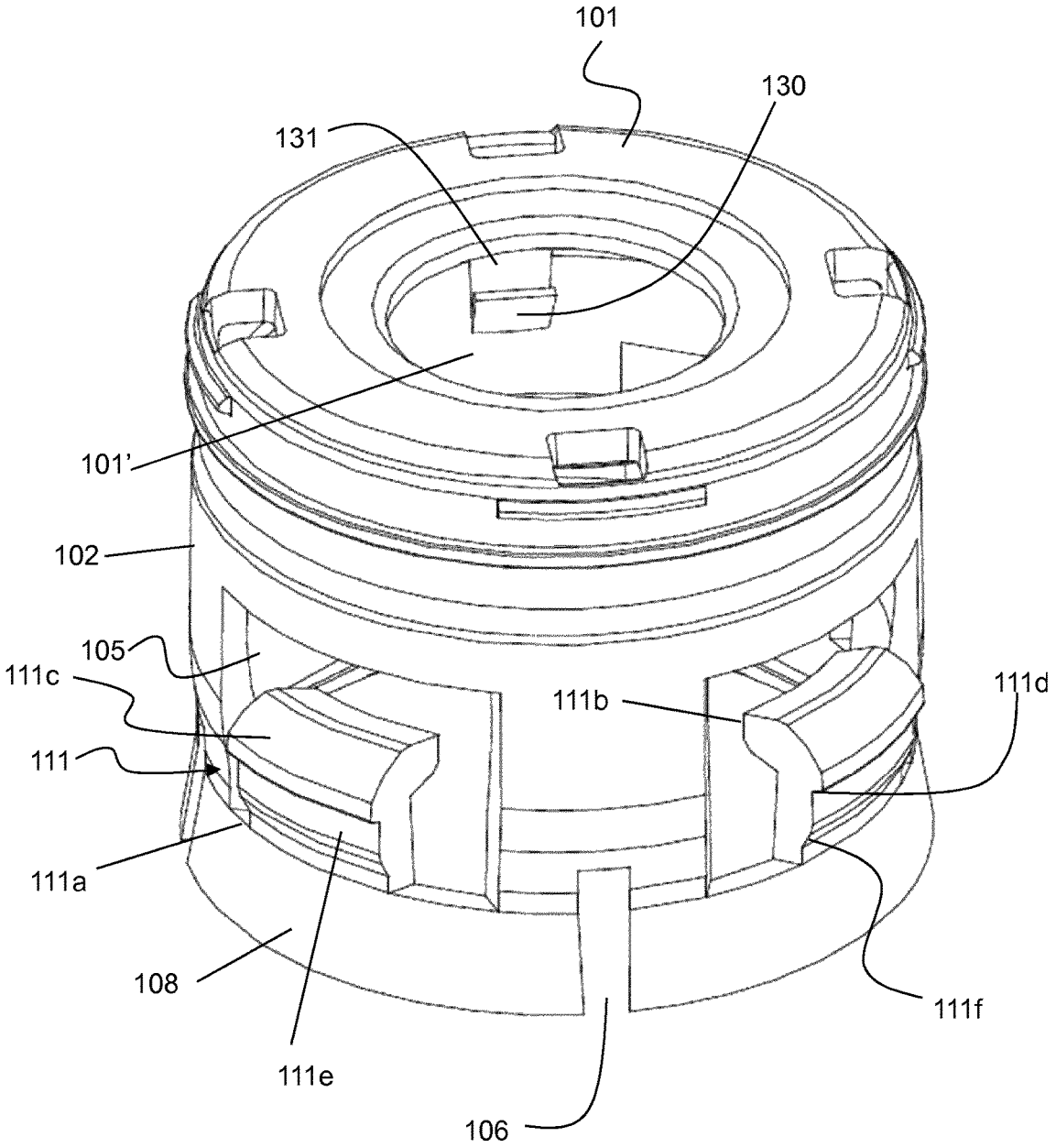
Figure 9A:
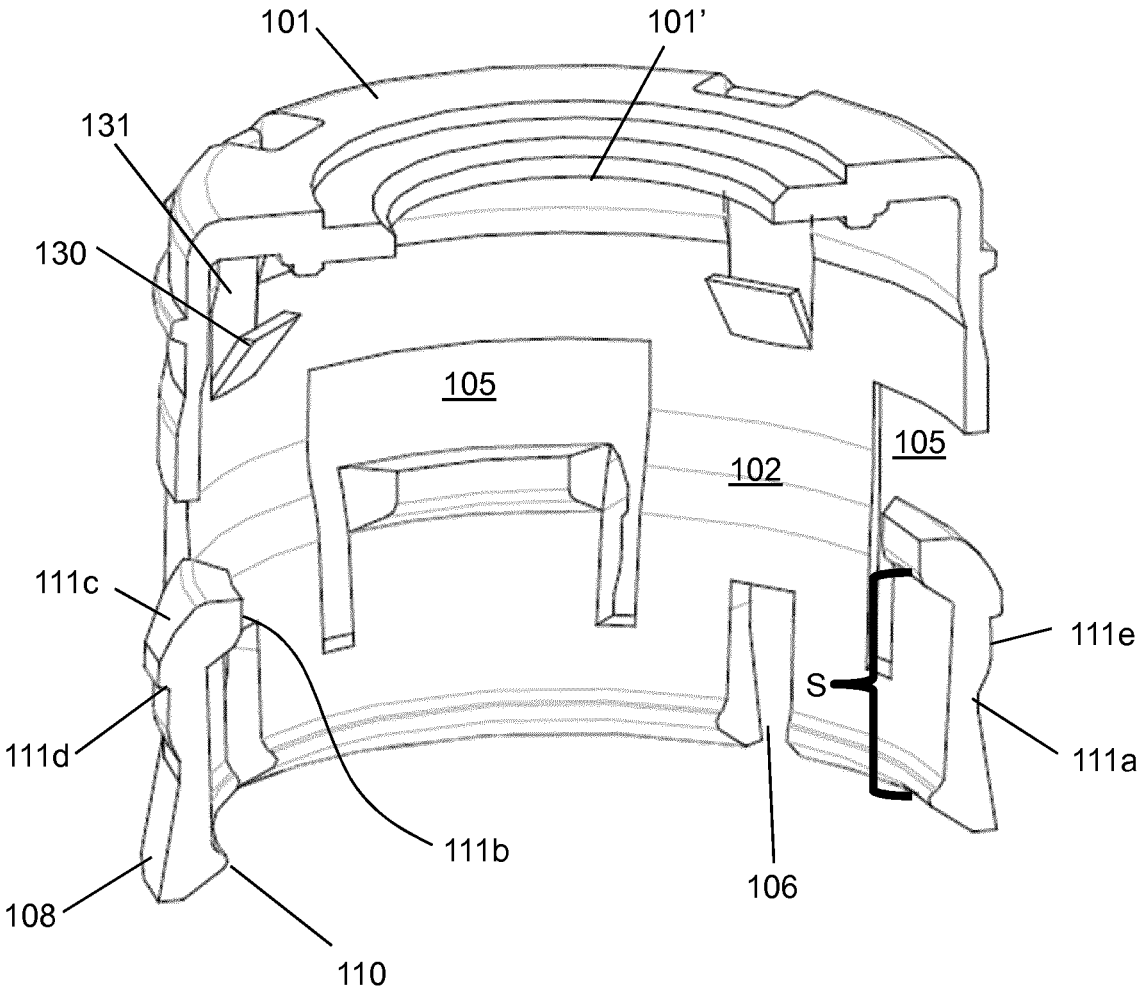
Figure 9B:
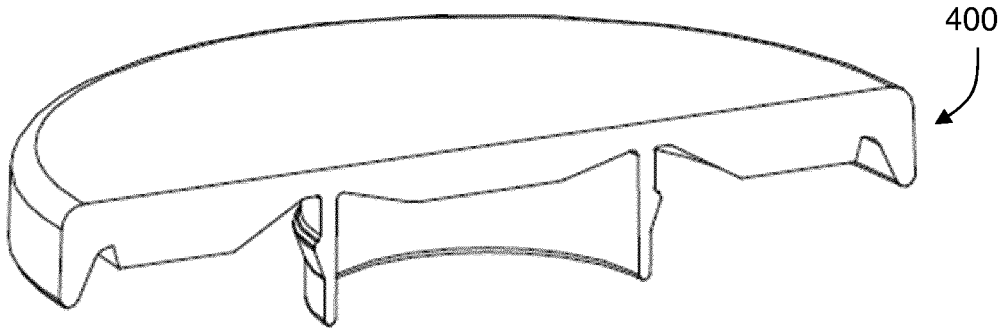
Figure 9C:
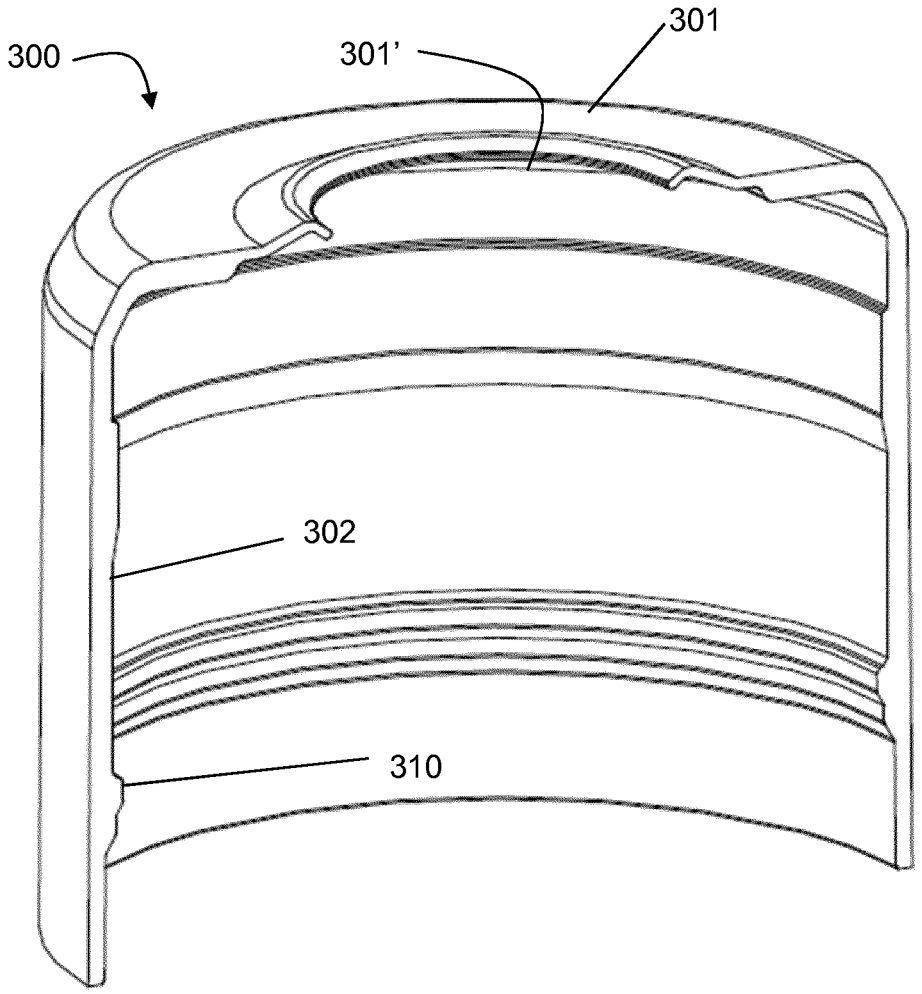
Figure 10:
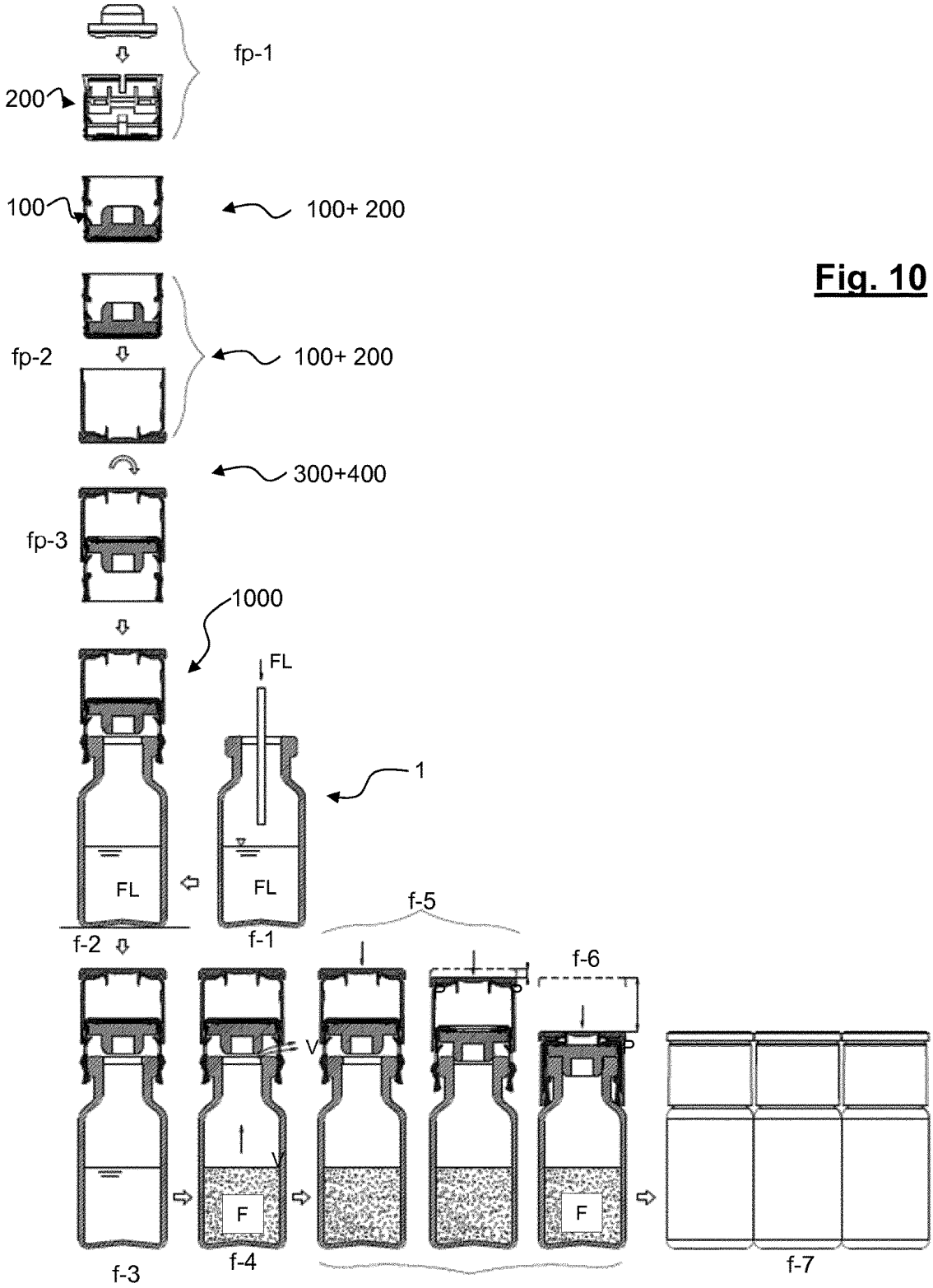

FIG. 8 shows a three-dimensional view of the cage of the assembly according to the present invention;

FIGS. 9*a*, 9*b* and 9*c* show three-dimensional cross-sections, respectively, of the cage, the cap and the ring nut of the assembly according to the present invention; and FIG. 10 shows how to preassemble the assembly and how to sealingly close the bottle with the preassembled assembly.

In the description which follows, all the position terms such as "upper", "lower", "lateral", etc., are used with reference to the figures. However, a component called "upper" (because shown in an upper position with respect to others) may be "lower" if turned upside down or turned round in another position. Therefore, these terms are not to be regarded as limiting the scope of protection. Typically, during assembly, some components may be overturned with respect to their position at the end of assembly or during use.

Figure 1:
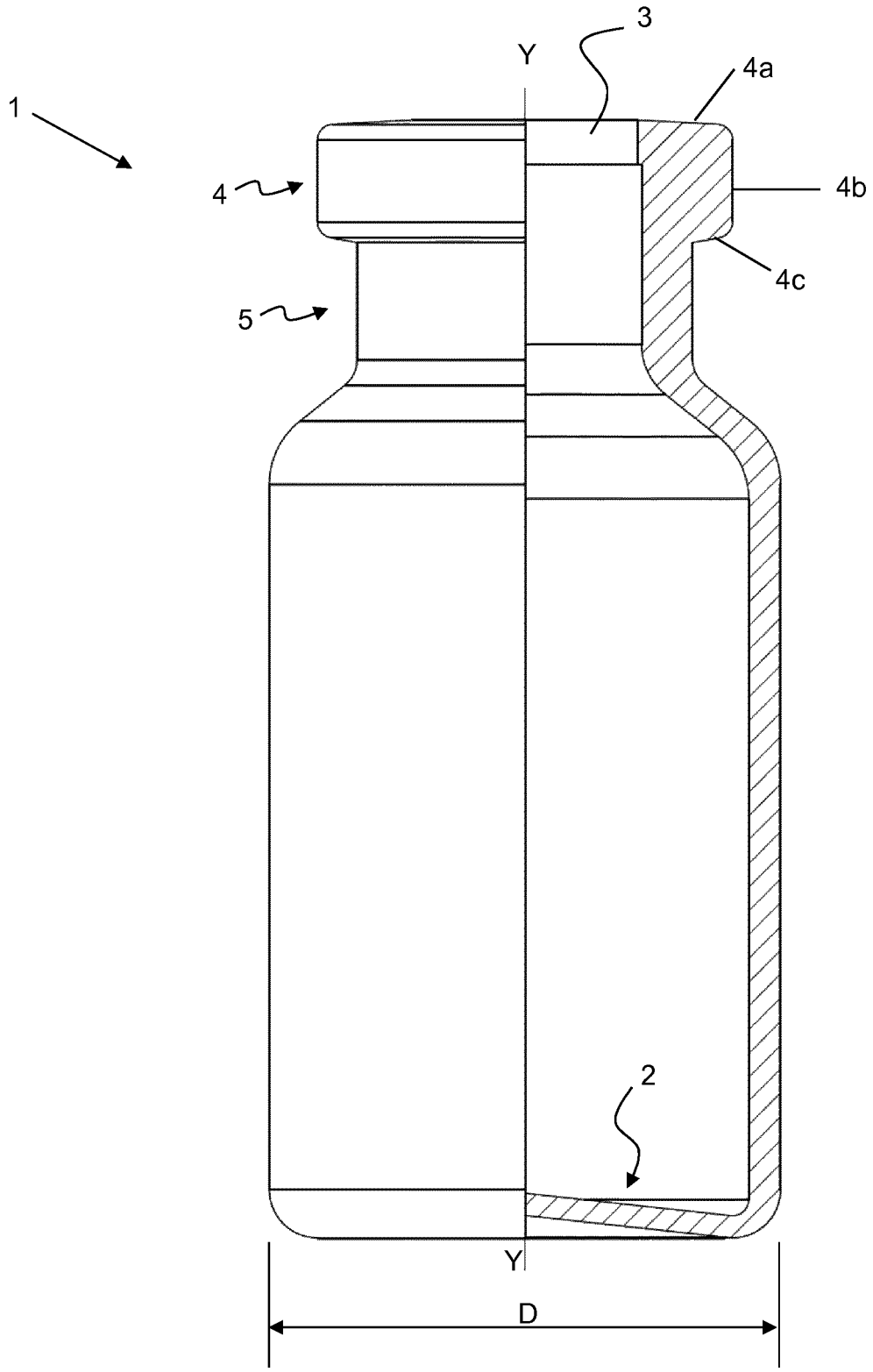
FIG. 1 shows, longitudinally sectioned, a bottle configured to be closed by means of the closing assembly according to the present invention.

With reference initially to FIG. 1, the bottle 1 comprises a substantially cylindrical body with a closed bottom 2 and an open mouth 3. An annular collar 4, namely a ring-like moulding which forms a protrusion extending radially outwards, is preferably provided in the region of the mouth 3. A neck 5 with an outer diameter smaller than that of the collar 4 is formed underneath the collar 4 and is connected to the bottom part of the substantially cylindrical body. Such a bottle is also conventionally known as a "penicillin type bottle". More precisely, the annular collar 4 comprises an upper surface 4*a* which is substantially horizontal (in reality it is slightly inclined downwards towards the outside), a substantially vertical side surface 4*b* and a lower surface 4*c* slightly inclined upwards towards the outside. The various top, side and bottom surfaces are connected together by means of curved surfaces. Preferably, the bottle is made of glass or a plastic material such as polyethylene, polyethylene terephthalate, PETG, PEHD or the like.

Figure 5:
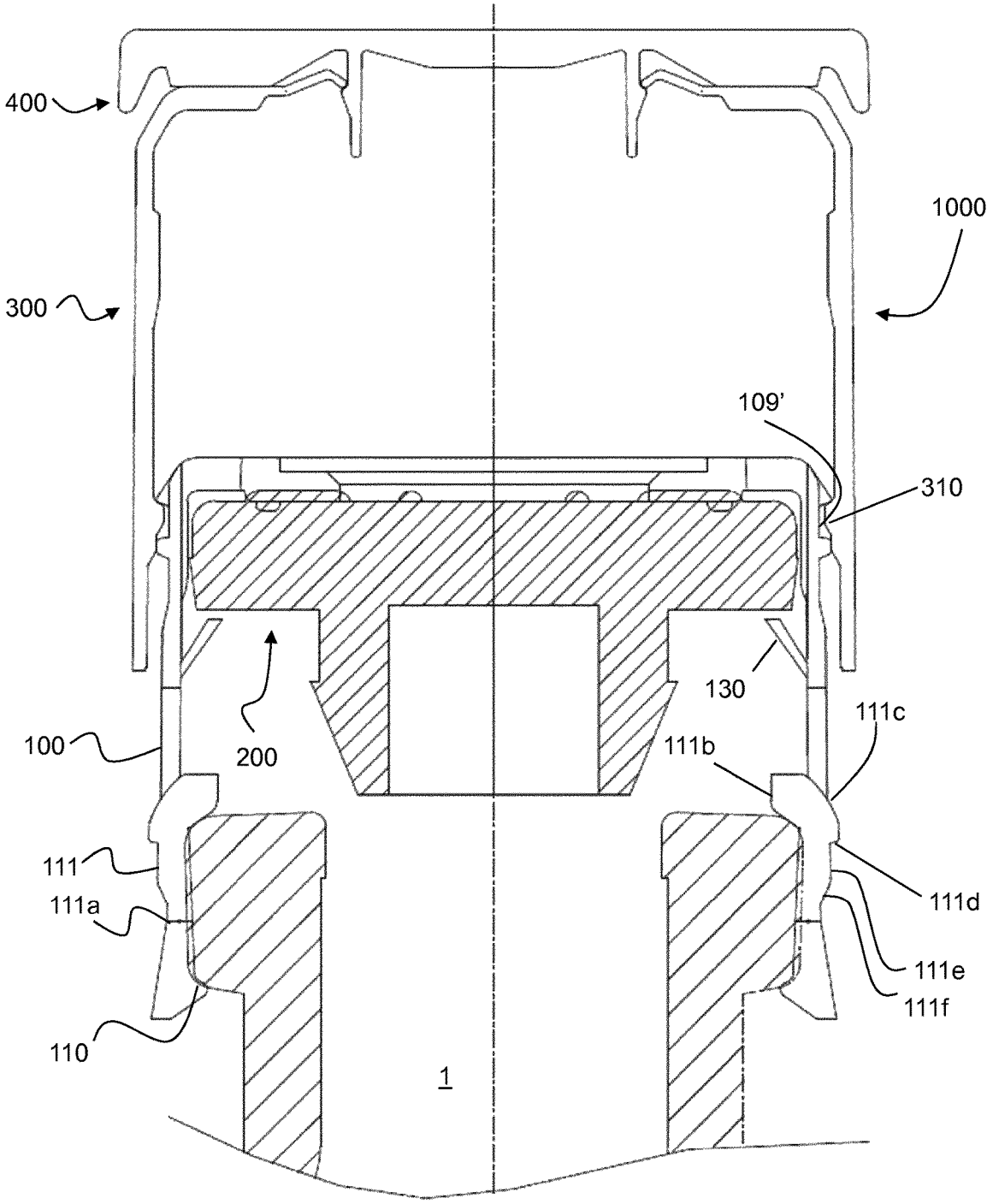
FIG. 5 shows, in an enlarged longitudinal section, the closing assembly according to the present invention, mounted on the mouth of a bottle, before closing is performed.

The closing assembly 1000 according to the invention is shown in FIGS. 5, 6 and 7. Hereinbelow the cage 100, the sealing stopper 200, the ring nut 300 and the protective sealing cap 400 will be separately described. Thereafter the mutual relationship of the various components and how to assemble them will be described.

Figure 2:
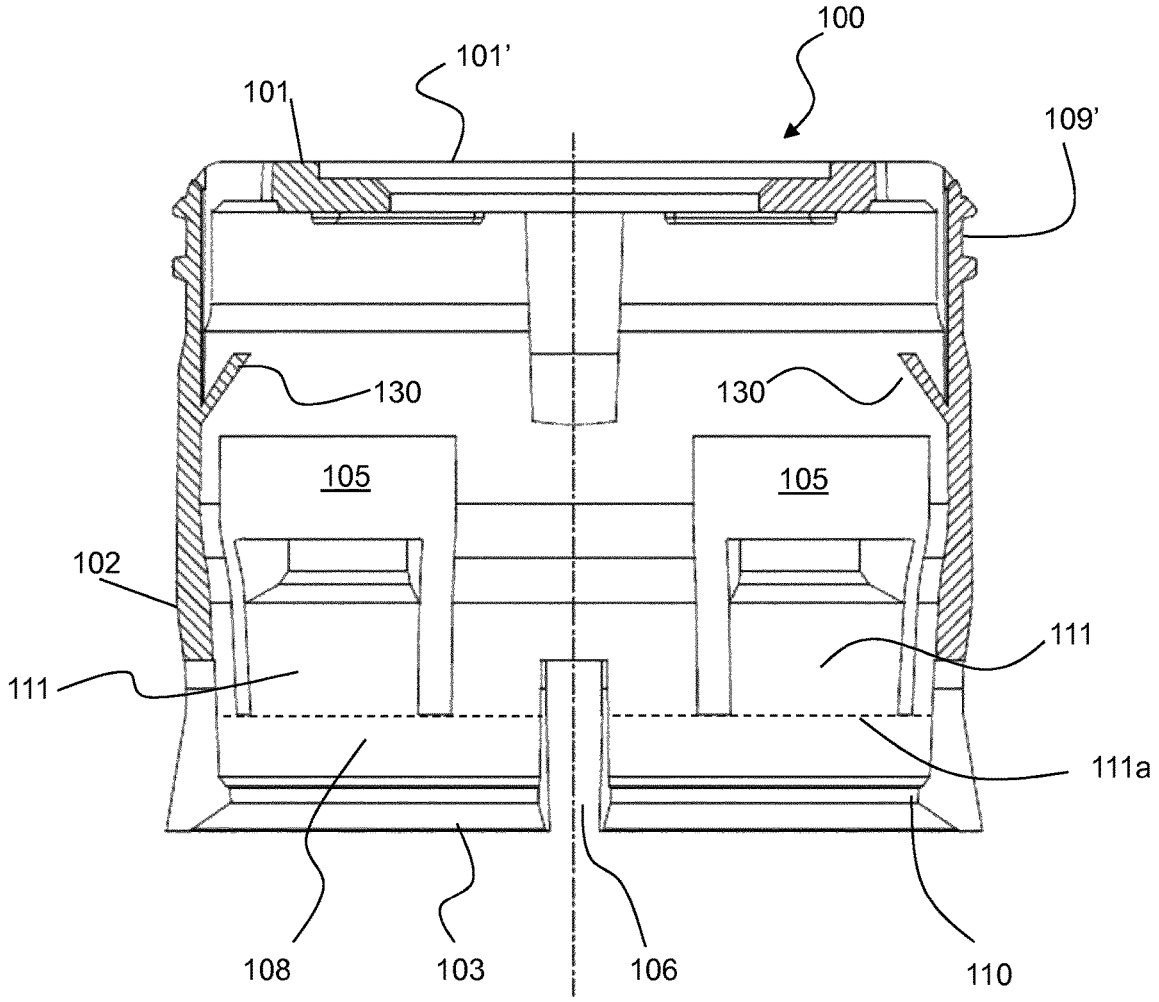
FIG. 2 shows, in an enlarged longitudinal section, the cage of the closing assembly according to the present invention.

With reference to FIGS. 2, 8 and 9*a*, the cage 100 will be described. The cage 100 is in the form of an overturned cup-shaped body with an upper base 101 which is closed (apart from an opening 101' which will be described below), a side wall 102 and an open lower base 103. Preferably, the side wall 102 comprises slits 106 which open out at the bottom towards the lower free edge of the cage 100. The slits 106 extend towards the upper base over a certain length. Preferably, the slits consist of a variable number and are arranged at regular or irregular intervals along the side surface 102.

The side wall 102 also comprises a plurality of windows 105. Each window 105 is arranged centred between two slits 106. In other words, each slit 106 is situated between two windows.

A rim 108 is formed between the lower free edge 100 of the cage and the lower edge of the windows 105. The rim 108 forms a substantially continuous ring which extends substantially along the entire side surface 102 of the cage and is interrupted only in the region of the slits 106. The rim 108 is shaped externally with an inclined surface which opens outwards. Internally, the free edge of the cage (which corresponds to the lower edge of the rim 108) is flared and shaped in the manner of a spur 110 which extends inwards.

In turn, the slits 106 preferably extend in the opposite direction to the free edge beyond the extension of the rim 108, into the surface section 102 between the windows 105.

Preferably, an engaging tongue 111 is provided for each window 105. The engaging tongue 111 is free on three sides and is connected only to a part of the lower edge of the window 105. In other words, the engaging tongue 111 is connected to the upper edge of the rim 108. As will become clear further below, the connection line between the engaging tongue and the rim 108 forms a hinge line 111*a* about which the engaging tongue 111 may rotate during the steps for preassembly and closure of the closing assembly. Preferably the slits 106 extend beyond the hinge line.

Preferably the slits 106 do not extend over the entire length of the engaging tongues, but extend over part of the length of the engaging tongues. For example, they extend over a length corresponding to between 30% and 40% of the length of the hinge line 111*a*.

With particular reference to FIGS. 8 and 9*a*, the shape of the engaging tongues 111 will be described in detail. Each engaging tongue 11 comprises an upper lip 111*b* directed inwards, a curved head 111*c*, a step 111*d*, a flat section 111*e* and an inclined section 111*f* which reaches the hinge line 111*a*.

The upper lip 111*b* and the lower spur 110 are suitably spaced so as to form a seat S for gripping the collar 4 of the bottle (FIG. 3) when the closing assembly 1000 is preassembled on the bottle 1. Preferably, the diameter of the cage 100 in the region of the tongue 111 and the rim 108 is such that it may be retained by bottles with a diameter between the maximum tolerance and the minimum tolerance.

Preferably, the head 111*c* has a pronounced curvature, namely a curvature given by a large radius. The curvature radius can be some millimetres. This allows the engaging tongue 111 to rotate about the hinge line 111*a* without the diameter of the sealing assembly exceeding the maximum diameter of the bottle 1 (FIGS. 6*a* and 6*b*).

The step 111*d* acts as a stop for a knee 310 of the ring nut 300.

The flat section 111*e* situated after the step 111 makes the tongue 111 stronger since, in this zone, the thickness is considerable. Thereafter, the inclined section 111*f* reduces the thickness of the tongue 111 and forms a weakening line 111*g* which allows rotation of the tongue 111. Obviously, the form of tongue 111 may be different from that shown provided that the tongue is capable of flexing outwards and returning elastically into the initial position at the end of assembly. Therefore, the thickness of the tongue may be reduced or not depending on the material which is used.

Preferably, the cage 100 is made of thermoplastic material and is produced by means of injection-moulding as one piece. A suitable material is, for example, polyethylene, polyethylene terephthalate, PETG, PEED or ABS (Acrilonitrile Butadiene Styrene).

Preferably, the inner surface of the side wall 102 of the cage 100 comprises one or more flexible retaining teeth 130 (for example four teeth) for retaining in position the head of the stopper 200 which will be described below. Each retaining tooth 130 preferably protrudes in a cantilever manner and is inclined relative to the inner surface of the side wall 102 of the cage 100. Preferably a recess 131 inside which the tooth 130 may retract is provided for each tooth 130. In this way, as will become clear below, the head of the stopper 200 may be pushed towards the base 101 of the cage 100 and retained in the correct position. During this stage, the teeth 130 retract elastically inside the respective niches 131 and then return into their initial projecting position. If necessary, the aforementioned teeth 130 may be modified in terms of their form so that, in addition to retaining the stopper, they may also ensure the centring thereof inside the cage 100 in order to allow correct positioning thereof on the mouth of the bottle.

Preferably, the upper base 101 of the cage comprises a hole 101'. Preferably, the hole 101' of the upper base of the cage is a central circular hole.

Figure 3:
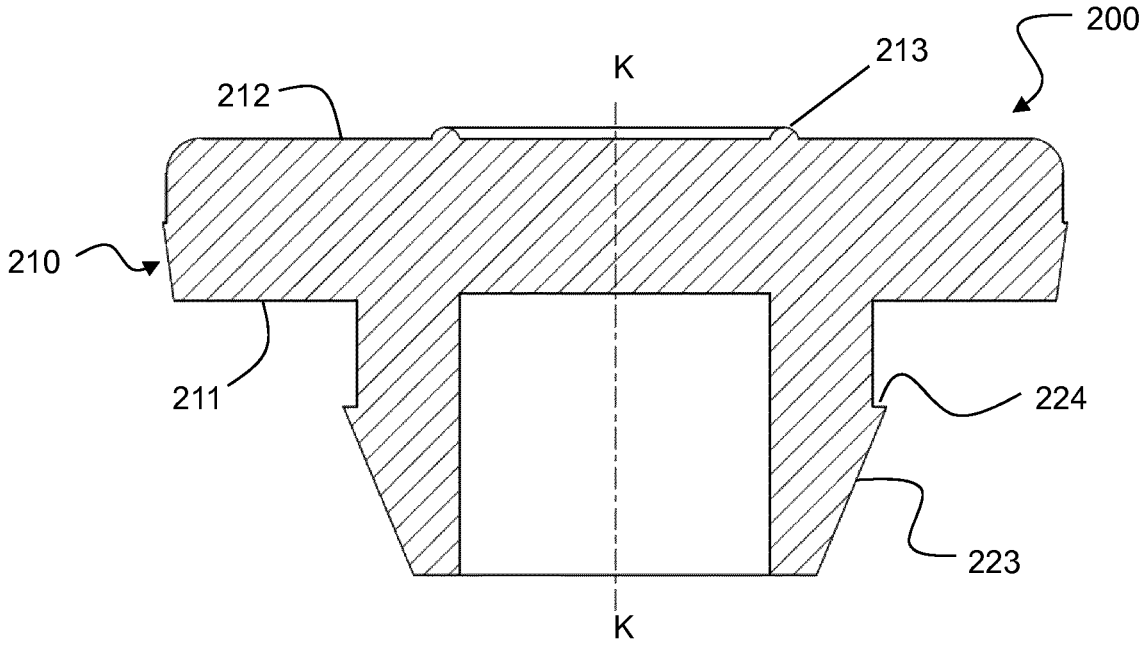
FIG. 3 shows, in an enlarged section, the stopper of the closing assembly according to the present invention.

With reference to FIG. 3 (and also the following figures) the sealing stopper 200 of the sealing assembly according to the present invention will now be described. The sealing stopper 200 comprises a head 210 and a shank 220. The head 210 is preferably in the form of a thick disc. The shank 220 is preferably cylindrical and broad. Preferably, the free end 222 of the shank is flared (223) as shown in FIG. 3. Preferably, the sealing stopper 200 is made of rubber or a similar material. The stopper 200 forms a sealing surface 211 designed to cooperate with the upper surface 4*a* of the collar 4 of the bottle 1 so as to ensure the sealing action. Preferably, the head 210 of the stopper 200 has an upper surface 212 which is substantially flat except for reliefs 213.

Figure 4:
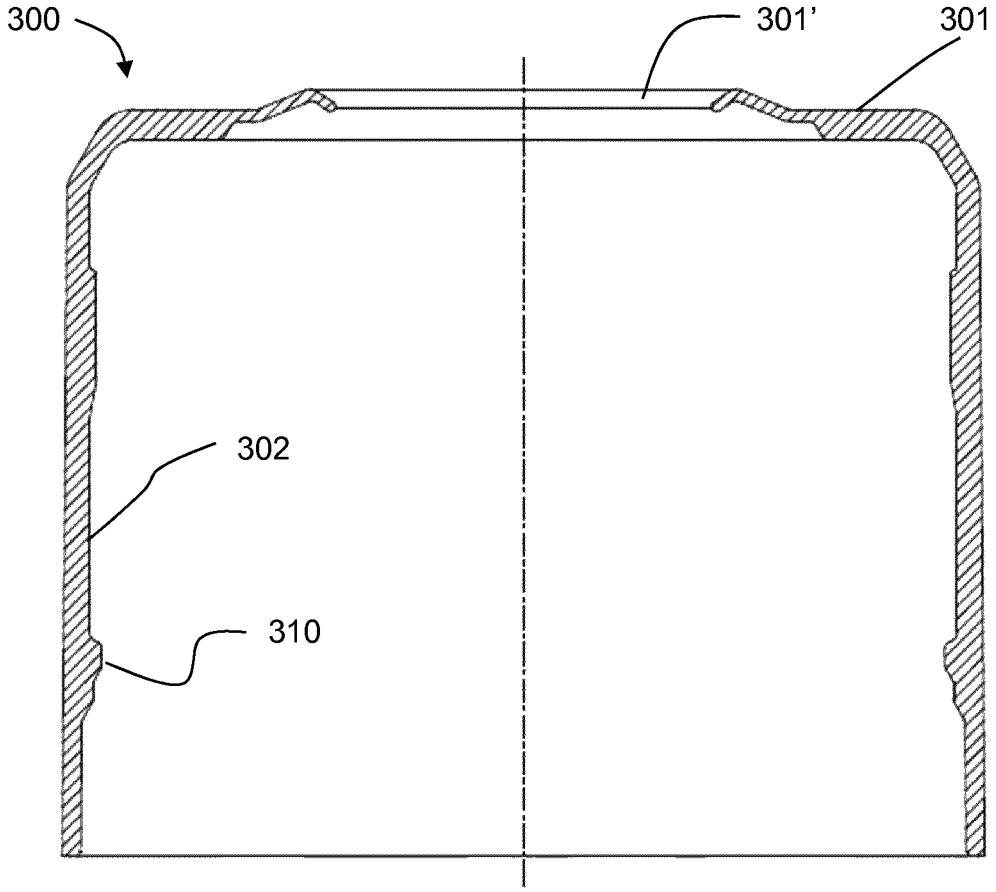
FIG. 4 shows, in an enlarged section, the ring nut of the closing assembly according to the present invention.

With reference to FIG. 4 and FIG. 9*c* the ring nut 300 will now be described. The ring nut 300 has preferably the shape of an overturned cup with an upper base 301 which is substantially closed and a side wall 302 which terminates in a free edge. Preferably, the ring nut 300 is made of a plastic material, but could also be formed from a metallic material such as aluminium or aluminium alloy.

Preferably, the side wall 302 of the ring nut 300 comprises a knee 310. The function of the knee 310 will be clarified below.

The upper base 301 of the ring nut may comprise a central opening 301', which is advantageously substantially circular.

According to the different known embodiments present on the market, a protection cap 400 (FIG. 9*b*) is provided, being engaged with the upper base 301 of the ring nut. The cap 400 has the function of sealing and protecting the perforation point of the sealing stopper 200. The cap 400 can be removed from the ring nut 300 by performing an upwards levering action, also using only the fingers of one hand. The cap 400 is preferably made of a plastic or thermoplastic material such as polyethylene, polyethylene terephthalate, PETG or PEHD or the like. When the cap is removed by the user a part of the upper surface of the head of the sealing stopper remains exposed, being delimited by the hole 101' of the cage 100 and the hole 301' of the ring nut 300. The sealing stopper may thus be pierced, for example, by a needle of a syringe so as to introduce into the bottle a certain amount of a liquid (for example a solvent) and then draw off the solvent with the solute. It is also possible to remove directly also a liquid which is already contained in the bottle and therefore which therefore does not need to be reconstituted. Preferably, the upper base 301 of the ring nut comprises a central opening 301', which is advantageously substantially circular.

FIG. 5 shows the assembly 1000 according to an embodiment of the invention preassembled and engaged with the collar of a bottle, before sealed closure is performed, this having been preceded by filling of the bottle with a substance and optionally by a step for treating the substance (for example, lyophilization).

FIG. 5 shows the collar of the bottle fully embraced by the seat S formed between the spur 110 and the tongues 111. In this configuration, if the bottle contains a liquid, lyophilization may be performed.

FIG. 6 shows in schematic form the sequence for sealed closure. During a first step (FIG. 6*a* and FIG. 7*a*), following a first downward pressure exerted on the assembly, the tongues 111 rotate slightly outwards, substantially around the hinge line 111*a* (the lip of the teeth passes from the surface 4*a* to the surface 4*b* of the bottle collar). Owing to the wide radius of curvature 111*c*, the diameter of the closing assembly does not exceed the diameter of the bottle also during this rotation.

During a second step (FIG. 6*b*), a further compression causes the upper lip 111*b* to engage with the surface 4*b* of the bottle collar. During this step, the lip is still forcedly rotated outwards around the hinge line 111*a*.

During a following step (FIG. 6*c*), a further compression causes the lip to engage with the surface 4*c* of the bottle collar and the closing stopper to be arranged in position on the mouth of the bottle. During this step, the tongues are rotated elastically and have resumed substantially their initial unstressed configuration.

In the configuration shown in FIG. 6*d*, the knee 310 is no longer retained inside the seat 109'.

In the configuration shown in FIG. 6*e*, the knee 310 is about to engage with the step 111*d*.

In the configuration shown in FIGS. 6*f* and 7*b*, finally, the knee 310 is engaged with the flat section 111*e* and closing is completed.

With reference to FIG. 10, a way in which the closing assembly 1000 may be assembled is now described. FIG. 10 also schematically shows, by way of example, the successive steps of engagement of the closing assembly with the bottle (preassembly) and, finally, sealed closure of the bottle by means of the closing assembly according to the invention.

During the preparatory step fp-1 the sealing stopper 200 is associated with the cage 100. Preferably the sealing stopper 200 has its shank directed upwards and the cage is placed with the open base 103 directed upwards so as to receive the head of the sealing stopper 200. During insertion of the stopper head, the retaining teeth 130 are retracted inside the respective recesses 131 and then snap back out so as to retain the sealing stopper 200 in position, as shown in the preparatory step fp-2.

Thereafter (preparatory step fp-3), the cage 100 (together with the sealing stopper 200) is inserted partially inside the ring nut 300. This step is preferably performed while still keeping the cage 100 (together with the sealing stopper 200) directed upwards. The cage 100 is only partially inserted inside the ring nut 300 in the sense that the knee 310 is seated inside the annular cavity 109' of the cage.

Preferably, before partially inserting the ring nut 300 onto the cage 100, the cap 400 has already been associated with the ring nut 300.

The closing assembly 1000, comprising the cage, the sealing stopper 200, the ring nut 300 and the cap 400, is placed in containers for sterilization.

Before or after the aforementioned preparatory steps, during a step f-1, the bottle is at least partially filled with a substance. This substance may be any substance in any state. For example, a pharmaceutical composition in the liquid, solid or other state.

In the step f-2 the closing assembly 1000 is fitted onto the bottle. Owing to the aforementioned particular features of the various components (and in particular owing to the tongues which perform an engaging/bearing function initially, the closing assembly is secured stably inside the open mouth 3 of the bottle. In fact, the annular collar 4 is positioned stably between the bead 110 and the lip 111*b*. In fact, the bead 110 and the lip 111*b* (as well as the surface portion between them) form a seat S which is perfectly adapted to the form of the collar 4 of the bottle 1.

Advantageously, the outer diameter of the cap 400 is smaller than the outer diameter of the bottle 1, also when the tongue 111 rotates about the hinge line 111*a*. This is a very advantageous aspect since it allows the bottles to be positioned against each other. This optimizes the spaces and keeps the bottles stable during the closing and sealing steps, as well as during packaging, transportation and/or storage.

In step f-3, the bottle and the closing assembly are substantially as in the step f-2. This allows, during sublimation in the lyophilization step, the gaseous part contained in the bottle to escape. In fact, the air may be extracted through the space between the stopper and the mouth of the bottle. The air is then allowed to pass through the windows 106 of the cage 100. The vacuum creation operation is schematically indicated by means of the arrows "V" in FIG. 10, step f-4. Owing to the form of the stopper (with a short shank), the evaporation performance is markedly improved compared to the solution with longer shank because the surface area is greater. The lyophilization time is much less than that of the conventional solutions.

During step f-5 a pressure directed downwards is exerted on the cap and therefore on the entire closing assembly. In particular, the pressure P exerted is such as to cause the collar 4 of the bottle to come out of the seat S. The tongues, which initially have an engaging/bearing function, ensure the sealing action at the end of assembly.

By exerting a greater pressure, the bottle is kept completely closed and sealed.

Step f-7 shows how the bottles may be moved upright adjacent to each other.

In general, the closing assembly thus finished may be easily used on all filling and sealing machines which exist today on the world market. The closing assembly in fact will be handled using the same structures (hopper, slides, etc.) which are used nowadays to convey only the rubber stopper for preassembly on the bottle, with modification of only a part of said structures depending on the format.

The closing assembly moreover is such that it may be used on high-speed automatic machines and, in particular, in connection with lyophilization, it allows all the closing, sealing, washing and drying operations to be performed inside the same room in a safe manner and with consequent savings in terms of costs, time, space, resources and personnel.

Finally, with the present closing assembly it is possible for any manufacturer to continue using their own sealing stopper since said assembly is able to receive any type of rubber stopper.

The closing assembly according to the present invention is very solid and stable when associated with a bottle. The walls of the cage are strong, but owing to tongues inside the respective windows, they provide a high degree of elasticity for gripping the collar of the bottle and sealingly closing said bottle.

Since the seat S has a very precise fit with the collar of the bottle, the use of the stoppering technique, which is more costly than conventional stoppers, is not required. A further positive consequence is that blow-back inside the mouth of the bottle is eliminated. This also helps reduce the costs since bottles with blow-back are more costly than the conventional bottles (used with the present invention) which do not have this characteristic.

It should be remarked that tongues 111 and retaining teeth 130 are properly shaped and configured in such a way that they do not constitute an obstacle when the stopper is inserted and when the assembly is mounted on the bottle. In fact, those parts move and adapt themselves according to the needs. During the insertion of the stopper and the arrangement of the assembly on the bottle, both the tongues 111 and the retaining teeth 130 maintain their shape and dimension.

As shown in the drawings, the flexible tongues 111 are shaped with a double curvature: a inner concave curvature which allows to assemble the assembly on the bottle because it slides and opens under the closing pressure and an outer convex curvature for facilitating the final sealing of the bottle. In addition, the two curvatures converge towards the end of the tooth, thus forming an acute angle which guarantees the safest sealing of the bottle.

The invention claimed is:

1. An assembly for closing a bottle, comprising:
a cage;
a closing stopper; and
a ring nut; wherein:
the cage is substantially cup-shaped and comprises a side wall with an inner surface comprising a bead and a lip spaced to form a seat for a collar of the bottle;
the closing stopper comprises a head, wherein the head comprises an upper surface and a lower surface;
the ring nut is cup-shaped and comprises a side wall;
the inner surface of the side wall of the cage comprises a retaining tooth for retaining in position the head of the closing stopper at the lower surface;
the retaining tooth projects cantilevered from the inner surface of the side wall of the cage;
the outer surface of the side wall of the cage comprises an annular cavity;
the side wall of the ring nut comprises an inner lower projection configured to engage the annular cavity in a preassembly configuration;
the side wall of the cage comprises a plurality of windows and each of the windows comprises a tongue connected to a portion of a lower edge of the window along a hinge line;
the lip is formed at a free end of each tongue;
each tongue is elastically rotatable about the hinge line; and
each tongue comprises a rounded head so that during assembly, engaging tongues can rotate about the hinge line without an outer diameter of the assembly exceeding a maximum diameter of the bottle.

2. The assembly according to claim 1, wherein each of the tongues comprises a step configured to act as a stop for the inner lower projection of the ring nut.

3. The assembly according to claim 2, wherein each of the tongues further comprises an inclined surface as far as the hinge line.

4. The assembly according to claim 1, wherein the side wall of the cage comprises a rim that extends circumferentially between a lower free edge of the cage and the lower edge of the windows.

5. The assembly according to claim 4, wherein the rim comprises a surface inclined outwards from the hinge line.

6. The assembly according to claim 4, wherein the rim comprises a plurality of slits.

7. The assembly according to claim 6, wherein the slits are open at the free edge of the cage and extend beyond the hinge line.

8. The assembly according to claim 7, wherein the slits extend over a length which is less than the height of the tongues.

9. A bottle comprising the assembly according to claim 1.

10. The bottle according to claim 9, wherein the outer diameter of the bottle is greater than the outer diameter of the assembly.

11. A method for assembling a closure assembly of a bottle to be assembled on a mouth of the bottle, the method comprising:
providing a cage, a closing stopper, and a ring nut, wherein:
the cage is substantially cup-shaped and comprises a side wall with an inner surface comprising a bead and a lip spaced to form a seat for a collar of the bottle;
the closing stopper comprises a head, wherein the head comprises an upper surface and a lower surface;
the ring nut is cup-shaped and comprises a side wall;
the inner surface of the side wall of the cage comprises a retaining tooth for retaining in position the head of the closing stopper at the lower surface;
the retaining tooth projects cantilevered from the inner surface of the side wall of the cage;
the outer surface of the side wall of the cage comprises an annular cavity;
the side wall of the ring nut comprises an inner lower projection configured to engage the annular cavity in a preassembly configuration;
the side wall of the cage comprises a plurality of windows and each of the windows comprises a tongue connected to a portion of a lower edge of the window along a hinge line;
the lip is formed at a free end of each tongue; and
each tongue is elastically rotatable about the hinge line;
each tongue comprises a rounded head so that during assembly, engaging tongues can rotate about the hinge line without an outer diameter of the assembly exceeding a maximum diameter of the bottle;

pushing the head of the sealing stopper towards the base of the cage;

partially fitting the ring nut on the cage so that the inner lower projection engages the annular cavity;

assembling the cage on the bottle so that the collar of the bottle abuts between the bead and the lip.

12. The method according to claim 11, further comprising providing a cap and engaging the cap with the ring nut.

* * * * *